United States Patent [19]

Long et al.

[11] 3,933,596

[45] Jan. 20, 1976

[54] DESULFURIZATION OF COKE

[75] Inventors: Raymond H. Long, Morristown; Morgan C. Sze, Upper Montclair, both of N.J.

[73] Assignee: The Lummus Company, Bloomfield, N.J.

[22] Filed: Apr. 1, 1974

[21] Appl. No.: 457,118

[52] U.S. Cl. ..... 201/17; 423/461; 201/44; 201/20; 201/36

[51] Int. Cl.[2] ..... C10B 57/00

[58] Field of Search ..... 201/17, 19, 20, 25, 36, 201/37, 38, 5, 6; 208/46, 131, 211, 226, 229, 230; 423/461

[56] References Cited

UNITED STATES PATENTS

| | | | |
|---|---|---|---|
| 2,657,118 | 10/1953 | Phillips et al. | 201/19 X |
| 2,698,777 | 1/1955 | Hartwick et al. | 201/17 |
| 2,793,172 | 5/1957 | Smith et al. | 201/17 |
| 3,472,622 | 10/1969 | Ridley | 201/17 |
| 3,600,130 | 8/1971 | Aldridge et al. | 201/17 |
| 3,723,291 | 3/1973 | Thakker | 201/17 |

*Primary Examiner*—Norman Yudkoff
*Assistant Examiner*—J. Sofer
*Attorney, Agent, or Firm*—Marn & Jangarathis

[57] ABSTRACT

Coke is desulfurized by calcining coke at a temperature of 1600° – 2200° F. in admixture with sodium carbonate, followed by direct contact with phosgene or a mixture of carbon monoxide and chlorine at a temperature of 1200° – 1800° F. to produce coke having sulfur contents of less than 0.5 percent.

13 Claims, 2 Drawing Figures

DESULFURIZATION OF COKE

Figure 2:
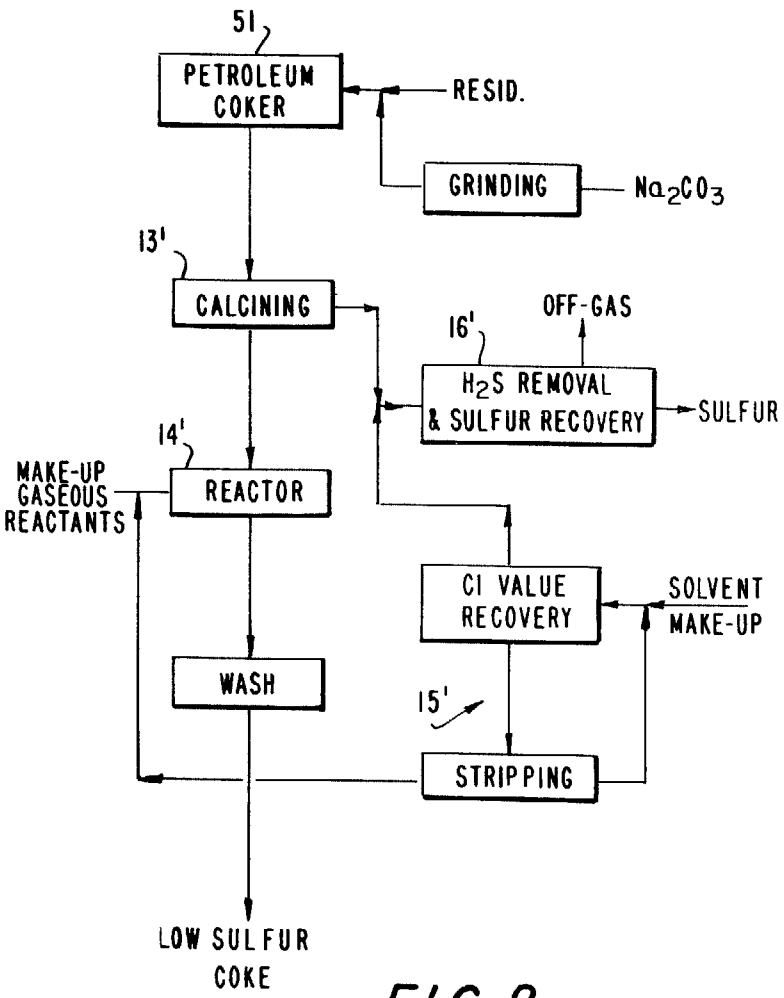

This invention relates to the desulfurization of coke, and more particularly to a new and improved process for producing a coke having a sulfur content of less than 0.85 percent.

There has been proposed a wide variety of processes for producing desulfurized coke. In general, however, such processes are not effective for producing a desulfurized coke from a wide variety of feedstocks having various sulfur contents, including sulfur contents of 4 percent and greater, which would meet standards of a sulfur content of less than 0.85 percent, and preferably less than 0.5 percent.

In our previously filed U.S. application Ser. No. 393,576, filed on Aug. 31, 1973, we have proposed a process for desulfurizing coke by use of a desulfurizing gas which was capable of reducing the sulfur content of the coke to less than 0.85 percent. In the preferred aspect of the process, however, as a result of the use of the ferruginous additive, the product coke had a relatively high ash content. Accordingly, there is a need for further improvements which would provide the required desulfurization, without the coke product containing the type and quantity of ash produced in accordance with the process of our previous application.

Accordingly, an object of the present invention is to provide for desulfurization of the coke.

Another object of the present invention is to provide desulfurized coke having a sulfur content of less than 0.85 percent, and preferably less than 0.5 percent.

A further object of the present invention is to provide a desulfurized coke with a lower ash content.

These and other objects of the present invention should be more readily apparent from reading the following detailed description thereof.

In accordance with the present invention, finely divided sulfur containing coke in admixture with a desulfurizing amount of sodium carbonate is heat treated, followed by direct contact with a desulfurizing gas, at an elevated temperature, with the total treatment being effective to reduce the sulfur content of the coke to less than 0.85 percent, and preferably less than 0.5 percent.

More particularly, the coke is admixed with a desulfurizing amount of sodium carbonate with such desulfurizing amount generally being at least 0.5 weight percent. Most generally, the sodium carbonate content is from about 1 percent to about 5 percent, preferably from about 2 percent to about 3 percent, all by weight, based on coke weight. In general, the sodium carbonate is not used in amounts in excess of 5 weight percent in that the use of such greater amounts will increase the residual ash content of the final coke product. The sodium carbonate is generally admixed with the coke by either drymixing the sodium carbonate with finely divided coke or spraying a solution of sodium carbonate onto the finely divided coke. As a further alternative, the finely divided coke can be pelletized utilizing sodium carbonate, as a part of the binder. For example, pellets can be formed by: applying aqueous sodium carbonate to a ground coke - Bentonite mixture; applying aqueous sodium carbonate — starch solution to ground coke; applying aqueous sodium carbonate to ground coke followed by drying and pelletizing or agglomerating with a petroleum resid, coal tar pitch or similar material, etc. The coke and sodium carbonate mixture is preferably pelletized prior to the subsequent heat treatment to minimize dust loss in further processing.

As a further alternative, the sodium carbonate could be added to the feedstock for producing the coke, prior to coking, whereby the coking product includes the sodium carbonate.

The coke in admixture with the sodium carbonate is then calcined, with such calcining generally being effected at a coke temperature from about 1600° to 2400°F., and preferably at a coke temperature from about 2000°F. to about 2300°F. The calcining is generally effected for at least about 0.5 hours, and most generally for a time in the order of 1 to 4 hours. It is to be understood that longer times could be employed, but in general, such additional time produces no significant additional beneficial results. In some cases, where the original sulfur content is low, shorter times may be possible.

The calcined coke is then treated with a desulfurizing gas to produce a coke product having a sulfur content of less than 0.85 percent. The desulfurizing gas is either a mixture of carbon monoxide and chlorine, or phosgene, and generally also includes a diluent gas, such as nitrogen, in order to minimize the concentration of phosgene (phosgene is also generated when using a mixture of carbon monoxide and chlorine). It is to be understood, however, that a diluent gas need not be present although the use of a diluent is preferred. Although the desulfurization is effected under reducing conditions, some oxygen can also be present in the gas; however, as should be apparent, oxygen would be consumed in combustion of coke so that significant oxygen content would result in a loss of product. In employing a mixture of carbon monoxide and chlorine, the relative proportions of the two materials can vary over a wide range, in that it is believed that the desulfurization is effected by in situ generation of phosgene. As should be apparent, it is most economical to employ the carbon monoxide and chlorine in amounts approximating equimolal amounts. Typically, the ratio of one of the two components to the other ranges from about 0.5:1 to 1.5:1. As should be apparent, however, the relative proportions can be outside such a typical range in that in situ phosgene generation can occur outside such ranges, although such an operation is not preferred.

The desulfurization with the desulfurizing gas is effected in a reducing atmosphere at a coke temperature from 1200°F. to 1800°F. and preferably at a coke temperature from 1400°F to 1800°F., with a coke temperature of 1500°F. being generally preferred. (The furnace or oven in which the desulfurization is effected is generally at a temperature which is 100°F. higher than the temperature of the coke). The desulfurization with phosgene or a mixture of carbon monoxide and chlorine cannot be effectively employed at coke temperatures in the order of 1900°F. and higher, and, accordingly, in general, the temperature of the coke does not exceed 1800°F. The coke is maintained at the desulfurization temperature for a time sufficient to reduce the sulfur content of the coke to no greater than 0.85 percent, and preferably no greater than 0.5 percent. The precise time required for such desulfurization will vary with the amount of sulfur originally present in the coke and the distribution, as to type, of the sulfur; i.e., pyritic, sulfate, sulfide, or organic. In general, the time is at least one-half hour, with the time period generally not exceeding 16 hours.

Typically, the required desulfurization time is in the order of 1 to 8 hours.

In accordance with the present invention, the coke which is admixed with the sodium carbonate should be in a finely divided state in order to permit subsequent diffusion of the desulfurizing gas on a relatively uniform basis. In the case of a delayed coke, in general, the coke should have a particle size of 100 percent minus 16 mesh and at least 30 percent (generally 30 to 70 percent minus 200 mesh; and in the case of a fluid coke, in general, the coke should have a particle size of 100 percent minus 100 mesh, and at least 50 percent (generally 50 to 70 percent) minus 325 mesh. The scope of the present invention, however, is not limited to such representative mixing particle sizes in that the particle size which is most effective for providing the subsequent required desulfurization will vary with the amount and type of sulfur present in the coke. In general, however, if smaller particles are used, the desulfurization is more easily accomplished; i.e., at lower temperatures, and/or shorter times, and/or with less sodium carbonate, etc. In general, with cokes having a sulfur content in the order of about 4 percent, the coke subjected to the desulfurization treatment should be finely divided to the particle sizes, as hereinabove described. It is to be understood that the heat treatment and desulfurization with the desulfurizing gas need not be effected with the coke in a finely divided state; e.g., in the preferred embodiment, the coke sodium carbonate mixture is pelletized prior to desulfurization.

The coke which is desulfurized in accordance with the present invention may be a coke produced from any one of a wide variety of carbonaceous coking feedstocks, including both liquid feedstocks derived from either petroleum sources, such as reduced crudes, gilsonite, tar sand bitumens and the like or coal sources, such as coal tar pitch or coal tar and solid feedstocks, such as coal.

The manner in which the coke is produced forms no part of the present invention and any one of a wide variety of coking procedures may be employed for producing the coke which is to be desulfurized. Thus, for example, a liquid carbonaceous feedstock, may be coked in a delayed or fluid coker, as known in the art, or in a carbonizer; e.g., an indirect-fired kiln type carbonizer, as known in the art. Coal may be carbonized in high temperature, slot-type coke ovens. Alternatively, the coal may be subjected to preheating and partial oxidation in a rabbled multiple-hearth furnace, followed by carbonization in one or more kiln-type carbonizers. As a further alternative, the coal may be agglomerated, for example, by briquetting, preheated and partially oxidized in a grate-kiln or rabbled unit and carbonized in a kiln, a grate kiln or a circular grate type unit.

The desulfurization with the desulfurizing gas may be effected in either a kiln or a fluid bed, a rabbled multiple hearth, a shaft furnace, or a fixed bed with multiple gaseous reactant inlets. The choice of a suitable unit (the unit must be capable of maintaining vapor type integrity) is deemed to be within the scope of of those skilled in the art.

Figure 1:
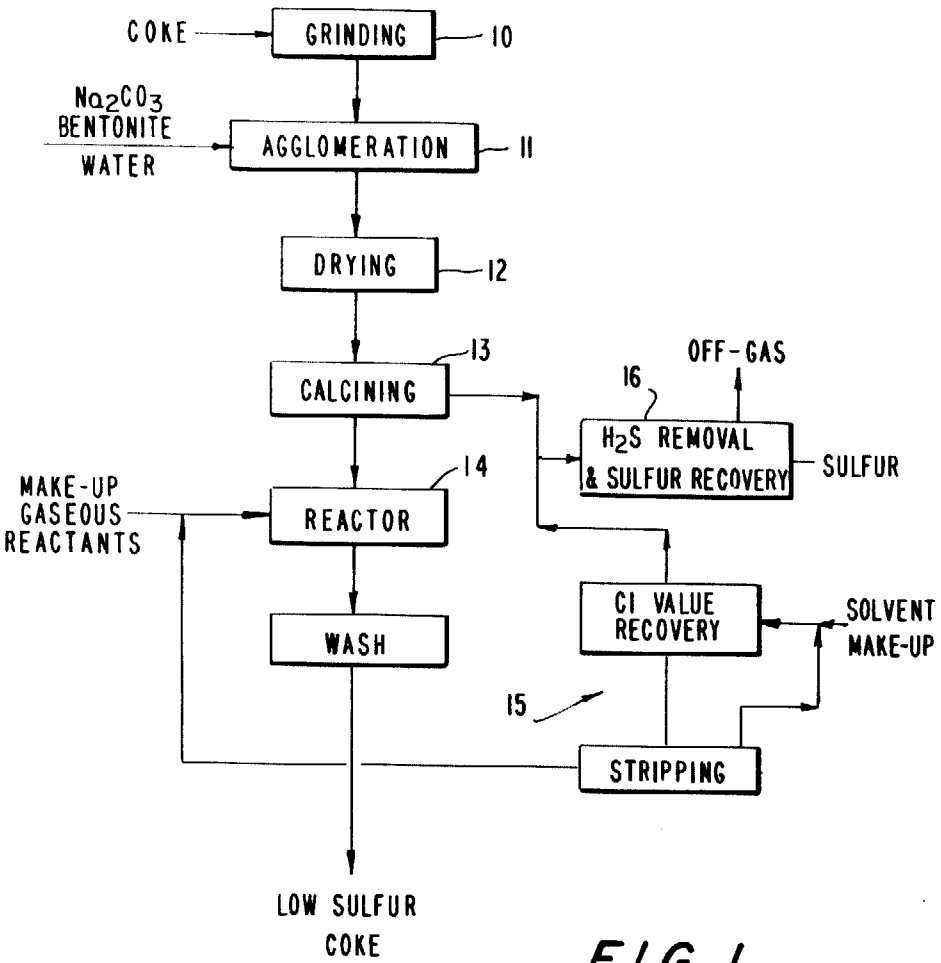

The invention will be further described with respect to the accompanying drawings wherein:

FIG. 1 is a schematic representation of one embodiment of the present invention; and FIG. 2 is a schematic representation of another embodiment of the present invention.

Referring to FIG. 1, coke is ground in a grinding zone 10 and then formed into pellets in zone 11 utilizing a sodium carbonate-water-Bentonite mixture. Zone 11 may include a conventional disk or drum pelletizer. Alternatively, the ground coke could be dry blended with pulverized sodium carbonate or sprayed with a sodium carbonate solution, followed by pelletizing using a conventional binder, such as petroleum resid, coal tar pitch, etc.

The pellets formed in zone 11 are dried in zone 12 and calcined, as hereinabove described, in zone 13. Zone 13 may include a rotary kiln for effecting the calcination.

The calcined pellets from zone 13 are then desulfurized in zone 14, as hereinabove described, by direct contact with the desulfurizing gas to produce a desulfurized coke having a sulfur content of less than 0.85 percent, and preferably less than 0.5 percent. Zone 14 may include a shaft furnace for contacting the coke and desulfurizing gas.

The pellets removed from zone 14 after cooling and washing can be used as a low sulfur, low ash fuel.

Alternatively, small pellets could be formed and zones 13 and/or 14 could include fluid bed units.

The effluent gas from zone 14 is introduced into zone 15 for recovery of chlorine values. Chlorine values may be recovered by by employing conventional solvents of the type used to absorb them, such as aromatic or chlorinated hydrocarbons followed by stripping of the absorbed chlorine values for recycle and reuse. Depending on the solvent used, ancillary treatment of the solvent could be required to prevent a gradual build-up of sulfur and/or sulfur containing compounds.

The gas from zone 15 is combined with the effluent gas from zone 13 and introduced into a sulfur recovery zone 16 for recovery of sulfur values. Zone 16 may include a hydrogen sulfide removal system and a Claus unit.

An alternative embodiment is illustrated in FIG. 2 wherein like parts are indicated by like prime numerals.

In accordance with the embodiment of FIG. 2, the sodium carbonate is ground and added to the feed to a coking zone 51. The coke produced in the coking zone 51 has sodium carbonate admixed therewith and may be introduced into the calcination zone 13. The remainder of the operation is as described with reference to FIG. 1.

The present invention will be described with respect to the following example, but the scope of the invention is not to be limited thereby.

EXAMPLE

Coke is desulfurized as reported in the following Table:

TABLE I

DESULFURIZATION OF COKE - TWO-STAGE TREATMENT
DELAYED COKE
(Sulfur Content, 4.6 Wt. %)

| First Stage | | | | Second Stage | | | |
|---|---|---|---|---|---|---|---|
| Run No.* | Additive Wt. % on Coke | Time & Temperature | First Stage Sulfur in Product, % | Gaseous Reactants Vol. % | Time & Temperature | Sulfur in Product, % | Percent Desulfurized |
| DC-1 | 3%$Na_2CO_3$ | 2 hrs. at 2000°F. | 1.12 | $Cl_2$ - 25<br>CO - 25<br>$N_2$ - 50 | 2 hrs. at 1600°F. | 0.76 | 83.5 |
| DC-2 | 3%$Na_2CO_3$ | 2 hrs. at 1900°F. | 1.6 | $Cl_2$ - 15<br>CO - 15<br>$N_2$ - 70 | 4 hrs at 1600°F. | 0.65 | 86 |
| DC-3 | 2%$Na_2CO_3$ | 2 hrs. at 2000°F. | 1.3 | $Cl_2$ - 10<br>Co - 10<br>$N_2$ - 80 | 4 hrs. at 1500°F. | 0.91 | 80.3 |
| DC-4 | 3%$Na_2CO_3$ | 2 hrs. at 2000°F. | 1.09 | $Cl_2$ - 10<br>CO - 10<br>$N_2$ - 80 | 4 hrs. at 1600°F. | 0.44 | 90.3 |
| DC-5 | 3%$Na_2CO_3$ | 2 hrs. at 2000°F. | 1.10 | $Cl_2$ - 25<br>CO - 25<br>$N_2$ - 50 | 4 hrs. at 1600°F. | 0.43/0.47 | 90.8/90. |

* All runs were made on delayed coke ground to 100% - 100 mesh, 50% - 200 mesh, and 10% - 325 mesh. $Na_2CO_3$ was sprayed on the coke as a 20% solution, and the coke then dried.

FLUID COKE
(Sulfur Content, 7.3 wt. %)

| First Stage | | | | Second Stage | | | |
|---|---|---|---|---|---|---|---|
| Run No.** | Additive Wt. % on Coke | Time & Temperature | First Stage Sulfur in Product, % | Gaseous Reactants Vol. % | Time & Temperature | Sulfur in Product % | Percent Desulfurized |
| FC-1 | 3%$Na_2CO_3$ | 2 hrs. at 2000°F. | 1.15 | $Cl_2$ - 25<br>CO - 25<br>$N_2$ - 50 | 2 hrs. at 1600°F. | 0.58 | 92 |
| FC-2 | 3%$Na_2CO_3$ | 2 hrs. at 1900°F. | 1.85 | $Cl_2$ - 15<br>CO - 15<br>$N_2$ - 70 | 4 hrs. at 1600°F. | 0.69 | 90.5 |
| FC-3 | 2%$Na_2CO_3$ | 2 hrs. at 2000°F. | 1.41 | $Cl_2$ - 10<br>CO - 10<br>$N_2$ - 80 | 4 hrs. at 1500°F. | 0.93 | 87.4 |
| FC-4 | 3%$Na_2CO_3$ | 2 hrs. at 2000°F. | 1.12 | $Cl_2$ - 10<br>CO - 10<br>$N_2$ - 80 | 4 hrs. at | 0.41 | 94.3 |
| FC-5 | 3%$Na_2CO_3$ | 2 hrs. at 2000°F. | 1.09 | $Cl_2$ - 25<br>CO - 25<br>$N_2$ - 50 | 4 hrs. at 1600°F. | 0.38/0.43 | 94.5/94. |

** All runs were conducted on fluid coke ground to 100% - 100 mesh, 70% - 200 mesh, and 40% - 325 mesh. $Na_2CO_3$ was sprayed on the coke as a 20% solution, and the coke then dired.

The present invention is particularly advantageous in that a coke having a sulfur content of no greater than 0.85 percent, and preferably no greater than 0.5 percent, may be produced from a wide variety of feedstocks having a wide variety of sulfur contents including those having sulfur contents of 4 percent or greater.

The process of the present invention, depending on the initial sulfur content of the feedstock employed in producing the coke, is capable of providing greater than 90 percent desulfurization of feedstocks having sulfur contents of 4 percent and greater.

For fuel applications, the desulfurized coke from the above treatment may be burned directly as a pulverized fuel with the potential of satisfying anti-pollution requirements with no further precautions.

Furthermore, the ash content of the desulfurized coke is generally less than 2 percent.

Numerous modifications and variations of the present invention are possible in light of the above teachings and, therefore, within the scope of the appended claims, the invention may be described otherwise than as particularly described.

What is claimed:

1. A process for desulfurizing coke, comprising:

a. heating coke in admixture with a desulfurizing amount of sodium carbonate at a coke temperature of from about 1600°F. to about 2400°F. for a period of at least 0.5 hour to calcine the coke, and b. thereafter contacting the coke from step (a) with a desulfurizing gas comprising a member selected from the group consisting of phosgene and a mixture of carbon monoxide and chlorine, said contacting being effected at a coke temperature from about 1200°F. to about 1800°F. to produce a coke with a sulfur content of no greater than 0.85 percent.

2. The process of claim 15 wherein said sodium carbonate is present in an amount from about 0.5 to about 5 percent, by weight.

3. The process of claim 2 wherein the contacting of step (b) is effected for at least 0.5 hours.

4. The process of claim 3 wherein the coke is a fluid coke, said fluid coke being mixed with the sodium carbonate prior to said heating, said fluid coke which is mixed with the sodium carbonate having a particle size of 100 percent minus 100 mesh and at least 50 percent minus 325 mesh.

5. The process of claim 4 wherein the mixture of fluid coke and sodium carbonate is pelletized prior to said heating.

6. The process of claim 5 wherein the desulfurizing gas comprises a mixture of carbon monoxide and chlorine.

7. The process of claim 6 wherein the heating of step (a) is effected at a coke temperature from about 2000°F. to about 2300°F.

8. The process of claim 7 wherein the contacting step (b) is effected at a temperature from about 1400°F. to about 1800°F.

9. The process of claim 3 wherein the coke is a delayed coke, said delayed coke being mixed with the sodium carbonate prior to said heating, said delayed coke which is mixed with the sodium carbonate, having a particle size of 100 percent minus 16 mesh and at least 30 percent minus 200 mesh.

10. The process of claim 9 wherein the mixture of delayed coke and sodium carbonate is pelletized prior to said heating.

11. The process of claim 10 wherein the desulfurizing gas comprises a mixture of carbon monoxide and chlorine.

12. The process of claim 11 wherein the heating of step (a) is effected at a coke temperature from about 2000°F. to about 2300°F.

13. The process of claim 12 wherein the contacting of step (b) is effected at a temperature from about 1400°F. to about 1800°F.

* * * * *